US005904329A

United States Patent [19]

Kanome et al.

[11] Patent Number: 5,904,329

[45] **Date of Patent: *May 18, 1999**

[54] ROLL-PAPER SUPPORTING MEMBER

[75] Inventors: Yuji Kanome, Yokohama; Osamu Asakura, Sagamihara, both of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/568,515

[22] Filed: Dec. 7, 1995

[30] Foreign Application Priority Data

Dec. 13, 1994 [JP] Japan ..... 6-309191

[51] Int. Cl.[6] ..... B65D 85/00

[52] U.S. Cl. ..... 248/201; 248/309.2; 206/395; 206/397; 206/416; 242/605

[58] Field of Search ..... 248/201, 309.2; 242/605, 596.7; 206/395, 397, 407, 415, 416; 229/149

[56] References Cited

U.S. PATENT DOCUMENTS

| | | | |
|---|---|---|---|
| 390,084 | 9/1888 | Lane | 242/596.7 X |
| 1,819,337 | 8/1931 | Pevear . | |
| 2,472,985 | 6/1949 | Pardee | 229/149 X |
| 2,475,279 | 7/1949 | Dunning | 229/149 |
| 3,338,399 | 8/1967 | Burt | 206/395 |
| 3,516,615 | 6/1970 | Wickenberg | 242/596.7 X |
| 4,431,139 | 2/1984 | Barnsbee et al. | 206/395 X |
| 4,699,534 | 10/1987 | Asakura et al. | 400/568 |
| 4,826,008 | 5/1989 | Cloosterman | 206/415 X |
| 5,022,524 | 6/1991 | Grady | 206/395 |
| 5,053,811 | 10/1991 | Watabe et al. | 206/397 X |
| 5,219,155 | 6/1993 | Kanome | 271/114 |
| 5,413,220 | 5/1995 | Sirianni | 206/395 |
| 5,449,010 | 9/1995 | Broderick | 206/396 |
| 5,484,082 | 1/1996 | Casper et al. | 221/305 |

FOREIGN PATENT DOCUMENTS

| | | | |
|---|---|---|---|
| 2682361 | 4/1993 | France | 206/397 |
| 5-9957 | 2/1993 | Japan . | |
| 5-9958 | 2/1993 | Japan . | |
| 92/09499 | 6/1992 | WIPO | 206/397 |

*Primary Examiner*—Ramon O. Ramirez
*Assistant Examiner*—Stephen S. Wentsler
*Attorney, Agent, or Firm*—Fitzpatrick, Cella, Harper & Scinto

[57] ABSTRACT

A pair of supporting members is removably attached to a containing box for supporting a roll sheet that consists of a cylindrical core and a recording sheet wound thereon. Each supporting member has a flat portion with an upper edge, a lower edge, and a center portion and a shaft portion mounted on the flat portion. A tapered portion contacting with an inner peripheral surface of the cylindrical core is formed on an outer peripheral surface of the shaft portion for supporting the roll sheet while the tapered portion is contacting an upper area thereof with an opposed area of the inner peripheral surface of the cylindrical core.

32 Claims, 9 Drawing Sheets

ROLL-PAPER SUPPORTING MEMBER

BACKGROUND OF THE INVENTION

1. Field of the Invention

The present invention relates to a member for supporting roll paper or sheet for home use or for business use such as the roll sheet for printing, a cooking paper and a paper towel and the manufacturing process of the above-described supporting member, the box for holding roll paper provided with a supporting member and the mounting process, further a recorder provided with the above-described box as a means for supplying a record medium and an information processing system such as a word processor and a facsimile provided with the above-described recorder as an output means.

2. Related Background Art

A box (hereinafter called "a holding box") for holding or containing roll paper for home use or for business use such as a cooking paper and a paper towel, and the roll sheet (hereinafter called the roll sheet for printing or only the roll sheet) used for a recorder for an information processing system such as a word processor and a facsimile has been proposed as a protecting case used when roll paper is transported or the box for holding roll paper when it is used. To make description clearly understandable, the roll sheet used for a recorder for an information processing system will be described below.

In the case of the roll sheet for printing provided with it held in the above-described case, the roll sheet holder is required for positioning between a word processor and the roll sheet when printing is performed on the roll sheet by a word processor or for smoothing rotation of the roll sheet in printing. Therefore, the roll sheet holder is sold together with the roll sheet or it is required to be bought separately. As a result, a problem that not only the manufacturing costs but their sales prices of the roll sheet and the roll sheet holder are high occurs. Therefore, the roll sheet holding box which can be utilized as a holder for supporting the roll sheet when it is used is proposed.

Utility Model Laid-Open Nos. 5-9957 and 5-9958 disclose the structure for holding the roll sheet for printing inside a case via a supporting member. FIGS. 12, 13 and 14 show the conventional three examples for holding the roll sheet inside a case via a supporting member.

FIG. 12 is a perspective drawing for explaining an example (the first conventional example) of the box for the roll sheet for printing disclosed in Utility Model Laid-Open No. 5-9957. In this example, a long shaft 103 with flanges at both ends functions as a supporting member and this long shaft 103 is through the hollow core of the roll sheet 102. Such design that the roll sheet 102 is set in the position where the peripheral surface of it is not contact with the inner wall of the box 101 is made. Further, the flanges are fixed on both side walls of the box 101. The end of the roll sheet 102 is output upward from an opening like a slit formed on the side of the box 101.

FIG. 13 is a perspective drawing for explaining another example (the second conventional embodiment) of the box for the roll sheet for printing disclosed in Utility Model Laid-Open No. 5-9958. In this example, the above-described long shaft 103 is flexible. As this flexible long shaft 103' can be reduced when it is not used, it can be housed in the box together with the roll sheet 102. When the long shaft is used, it is stretched and is through the hollow core of the roll sheet 102 to support the roll sheet 102, and in the meantime, both ends of the shaft are fixed on the side walls of the box 101.

FIG. 14 is a perspective drawing for explaining the other example (the third conventional embodiment) of the box for the roll sheet for printing disclosed in Utility Model Laid-Open No. 5-9957. In this example, a pair of holding plates 134 are used in place of the above-described long shaft 103 or 103'. The holding plate 134 consists of a rectangular plate member 134*a* and a cylindrical shaft 134*b* mounted on the center of the surface of the above-described member. When they are used, a pair of holding plates are disposed on both side walls of the box 101 with the shafts of them opposite each other and the two opposite shafts 134*b* function as the roll sheet supporting member by inserting them into the hollow core from both sides of the roll sheet. The holding plates 134 are fixed on the inner side walls of the box 101.

However, the box for the roll sheet proposed in Utility Model Laid-Open Nos. 5-9957 and 5-9958 have the following problems:

In the above-described first conventional embodiment, a longer shaft than the width of the roll sheet is used and the long shaft is constituted so that it always supports the roll sheet both when used and transported. Therefore, both the shaft and the box are required to be formed by material and in a shape much stronger than the minimum strength required when they are used. As a result, their manufacturing costs and sales price are higher. Further, the long shaft is constituted so that it is through the hollow core of the roll sheet and both ends of it are protruded from those of the roll sheet. Therefore, it is difficult to wrap the roll sheet in a member such as a protective sheet for protecting the roll sheet from environmental changes of temperature and humidity. In the meantime, if the roll sheet is not wrapped in the above-described member, a problem that the quality of paper is deteriorated to result in the deterioration of printing quality while the roll sheet is stored in a physical distribution storehouse or a shop occurs.

In the above-described second conventional embodiment, a flexible and complicatedly-shaped shaft is required. Therefore, as an elastic member such as a spring is required to be provided in a shaft and a plurality of cylindrical members with different diameters are required, not only the manufacturing process is complicated and the manufacturing costs are increased but the sales price is higher.

In the above-described third conventional embodiments, the box is required to be much larger-sized than the size of the box required in the above-described first or second conventional embodiment to wrap the roll sheet in a protective sheet and to house a supporting member together with the wrapped roll sheet in the protective sheet in the box. Therefore, the manufacturing costs of the box and the costs required to enable disassembly of the supporting member are higher. A problem that a considerable large gap is made between the box and the roll sheet when the roll sheet is used and positioning between the roll sheet and the box is insufficient occurs. Further, a problem that if the supporting member is not housed together with the roll sheet, it may be lost when it is not used for printing occurs.

The supporting member in the above-described first, second and third conventional embodiments is considered to be disposed in a approximately concentric circle of the shaft through the core of the roll sheet and a gap between the peripheral surface of the supporting member and the inner surface of the hollow core of the roll sheet is considered to be small enough though the rotation of the roll sheet is not prevented. The supporting member with such structure is required to be manufactured with high precision of the dimensions. The reason is that for example, if the core of the shaft of the supporting member is a little tilted based upon the surface in the lateral direction of the box (not parallel with the above-described surface), the roll sheet supported by the supporting member is also housed in the box with it tilted by the same angle. As a result, if the inner wall of the box or the supporting surface of the supporting member and the end surface of the roll sheet are close, the end of the roll sheet is contact with the inner wall of the box to result in damage of the roll sheet and poor rotation in printing. In such a case, as the roll sheet is not carried regularly, trouble that a plurality of lines are recorded repeatedly in the same location on the roll sheet occurs.

SUMMARY OF THE INVENTION

Therefore, the object of the present invention is to solve the above-described problems and to provide a supporting member for the roll sheet for printing owing to which positioning between a word processor and the roll sheet and the rotation of the roll sheet in printing can be smoothly implemented, the box for the roll sheet for printing provided with the above-described supporting member, a recorder with the above-described box as one of record medium supply means and an information processing system with the above-described recorder as an output means such as a word processor and a facsimile.

To solve the above-described problems, each of a pair of roll sheet supporting members according to the present invention for supporting the roll sheet disposed so that it can be attached or detached freely in the box for holding the roll sheet consisting of the cylindrical core and recording paper wound on the core so that the above-described roll sheet can be rotated freely comprises a flat portion provided with the upper edge, the lower edge and the center and a shaft attached in the position off on the side of the above-described upper edge from the center of the flat portion on the above-described flat portion, and further, is characterized by forming a tapered portion provided with the peripheral surface for hanging the above-described roll sheet in contact with the inner wall of the above-described core on the above-described shaft.

It is preferable that the center of the above-described supporting member is located on an extended line of the rotation axis of the above-described roll sheet or in the vicinity when it is disposed as described above.

It is preferable that the roll off in dimensions in which the above-described shaft can be inserted in time of need is formed on the above-described flat portion, the above-described pair of supporting members are opposite each other and they are overlapped when one supporting member is rotated by 180 degrees around the above-described center or the vicinity, and that a base portion formed by protruding at least a part of the above-described flat portion is provided and at least the above-described shaft is on the above-described base portion.

It is preferable that the above-described center is located on the above-described base portion, the above-described base portion is approximately a cylinder or the section is an arc and further the minimum diameter of the above-described base portion is larger than the inner diameter of the core of the above-described hollow cylinder, and that the height of the above-described base portion is equal to the length of the above-described shaft or larger than it.

It is preferable that a mark is put on the vicinity of the lower edge of the above-described flat portion, the above-described supporting member consists of a molding obtained by vacuum forming of sheet material consisting of predetermined material, and that the above-described predetermined material is thermoplastic resin and preferably strong impact-resistant polystyrene.

Next, the manufacturing process of the supporting member according to the present invention is characterized by provision of a process for forming the above-described supporting member by vacuum forming of sheet material consisting of predetermined material in a process for manufacturing the supporting member, and it is preferable that the above-described predetermined material is thermoplastic resin and preferably strong impact-resistant polystyrene.

The box for the roll sheet according to the present invention is provided with the roll sheet consisting of the hollow cylindrical core and recording paper wound on the core, a pair of supporting members for supporting the roll sheet so that it can be rotated freely, the box for holding the above-described roll sheet and the above-described pair of supporting members and a cover for covering the opening of the box so that it can be opened or closed freely, and the above-described supporting member comprises a flat portion provided with the upper edge, the lower edge and the center and a shaft mounted in the position off on the side of the above-described upper edge from the center of the flat portion on the above-described flat portion, and further the above-described shaft is characterized by provision of a tapered portion provided with the peripheral surface for hanging the above-described roll sheet in contact with the inner wall of the above-described core.

It is preferable that the center of the above-described supporting member is located on an extended line of the rotation axis of the above-described roll sheet when the supporting member is disposed, the roll off in dimensions in which the above-described shaft can be inserted in time of need is formed on the above-described flat portion, and that the above-described pair of supporting members are opposite each other and they are overlapped by rotating one supporting member by 180 degrees around the above-described center or the vicinity.

It is preferable that the above-described pair of supporting members are housed in the above-described box with them overlapped as described above when they are not used, a base portion formed by protruding at least a part of the above-described flat portion is provided and at least the above-described shaft is located on the above-described base portion, and that the above-described center is located on the above-described base portion.

It is preferable that the above-described base portion is approximately a cylinder or the section is an arc and further the minimum diameter of the base portion is larger than the inner diameter of the core of the above-described hollow cylinder, the height of the above-described base portion is equal to the length of the above-described shaft or larger than it, and that a mark is put on the vicinity of the lower edge of the above-described flat portion.

It is preferable that the above-described box is provided with a fixing means for fixing and supporting the above-described supporting member on the inner end surface of the box so that the supporting member can be attached or detached, the above-described supporting member consists of a molding obtained by vacuum forming of sheet material consisting of predetermined material, and that the above-described predetermined material is thermoplastic resin and preferably strong impact-resistant polystyrene.

The process for box the above-described roll sheet and the above-described supporting member in the box according to the present invention is characterized by box the roll sheet and the pairs of supporting members with one another independent in the box.

It is preferable that the above-described roll sheet is packed separately apart from the above-described pairs of supporting members, and that the above-described process comprises a process wherein the above-described pairs of supporting members are opposite each other and the pair of supporting members are overlapped by rotating one supporting member by 180 degrees around the above-described center or the vicinity, a process wherein one surface of the overlapped pair of supporting members is in contact with one end of the above-described box respectively and a process wherein one end of the roll sheet and the supporting member are disposed oppositely in space adjacent to the supporting member in contact with the one end.

It is preferable that in printing the shaft of the above-described supporting member is inserted into the core of the above-described roll sheet and that the roll sheet is positioned in the lateral direction in the above-described box by box the roll sheet in the box, controlling the lateral direction of the roll sheet on the base portion of the supporting member.

A recorder according to the present invention is provided with the above-described box as one of recording paper supply means and further, is characterized by provision of a recording means for recording input image information by emitting ink droplets on the above-described recording paper.

It is preferable that the above-described recording means uses an electrothermal conversion element which generates film boiling in ink as an energy generation means for emitting ink droplets, and that an information processing system according to the present invention includes a word processor and a facsimile characterized by provision of the above-described recorder as an output means.

The roll sheet consisting of the hollow cylindrical core and recording paper wound on the core is hung from both ends of the roll sheet by a pair of shafts of supporting members. At this time, an extended line of the rotation axis of the roll sheet and the center or the vicinity of the supporting member are crossed. Therefore, the roll sheet rotated by pulling one end of the roll sheet is rotated as if the center or the vicinity of the supporting member were a rotation axis.

The above-described shaft hangs the roll sheet in contact with the inner wall of the above-described core on the peripheral surface of the tapered portion. Therefore, the roll sheet is located in a predetermined position along the direction of the axis of the roll sheet every rotation of it.

As the roll sheet and the supporting members can be housed in the box independently, the roll sheet is readily packed. Therefore, only the roll sheet can be readily packed when sold or transported and further, both the supporting members and the box can be manufactured not so that they have strength required when they are sold or transported but so that they have the minimum strength required when they are used for printing.

As the supporting members can be overlapped, the box space in the box can be minimized. Such an overlapped condition is preferable when they are sold or transported because the overlapped supporting members have larger strength than one member.

As a long shaft through the core of the roll sheet is not required, the material cost can be kept cheap. When the supporting members are sold or transported other than when used for printing, each shaft of the pair of supporting members is combined with the roll off of the other supporting member and is housed together with the roll sheet in the box, and when they are used, the roll sheet can be positioned in the lateral direction precisely in the box by inserting the shafts of the supporting members into the hollow core of the roll sheet and box the roll sheet in the box, controlling the lateral direction of the roll sheet with the base portions of the supporting members. Both when used and when not used, the roll sheet and the supporting members can be efficiently housed and the supporting members are seldom lost when they are not used.

As the supporting members consist of moldings obtained by vacuum forming of sheet material made of thermoplastic resin and preferably strong impact-resistant polystyrene, they have high rigidity, strength, a smooth surface, high dimensional stability, little warp, further high heat and chemical resistance. As the supporting members are thin and rigid, and a large number of supporting members can be readily manufactured at a time because they are formed as described above, they can be manufactured at low costs.

It is preferable that a recorder uses an electrothermal conversion element as an energy means for emitting ink droplets. Therefore, as a recording means using the electrothermal conversion element as an energy generation means can generate bubbles in ink in a passage by correspondence of one for one by a drive pulse signal and bubbles can be grown or shrunk immediately and appropriately, emitting ink droplets excellent particularly in responsibility can be achieved. As the recording means can be readily compacted, the merits of IC techniques and microcomputer processing techniques of which progress of technology and enhancement of reliability are remarkable in the recent semiconductor field can be applied more than enough, high density packaging is facilitated, and the manufacturing cost is low-priced, the recording means is profittable.

BRIEF DESCRIPTION OF THE DRAWINGS

FIG. 2A is a plan and FIG. 2B is a cross sectional view along a line 2B—2B in FIG. 2A;

9A is a plan view and FIG. 9B is a cross sectional view along a line 9B—9B in FIG. 9A;

FIG. 10A shows the case of one supporting member and FIG. 10B shows the case that a pair of supporting members are combined;

DETAILED DESCRIPTION OF THE PREFERRED EMBODIMENTS

Figure 1:
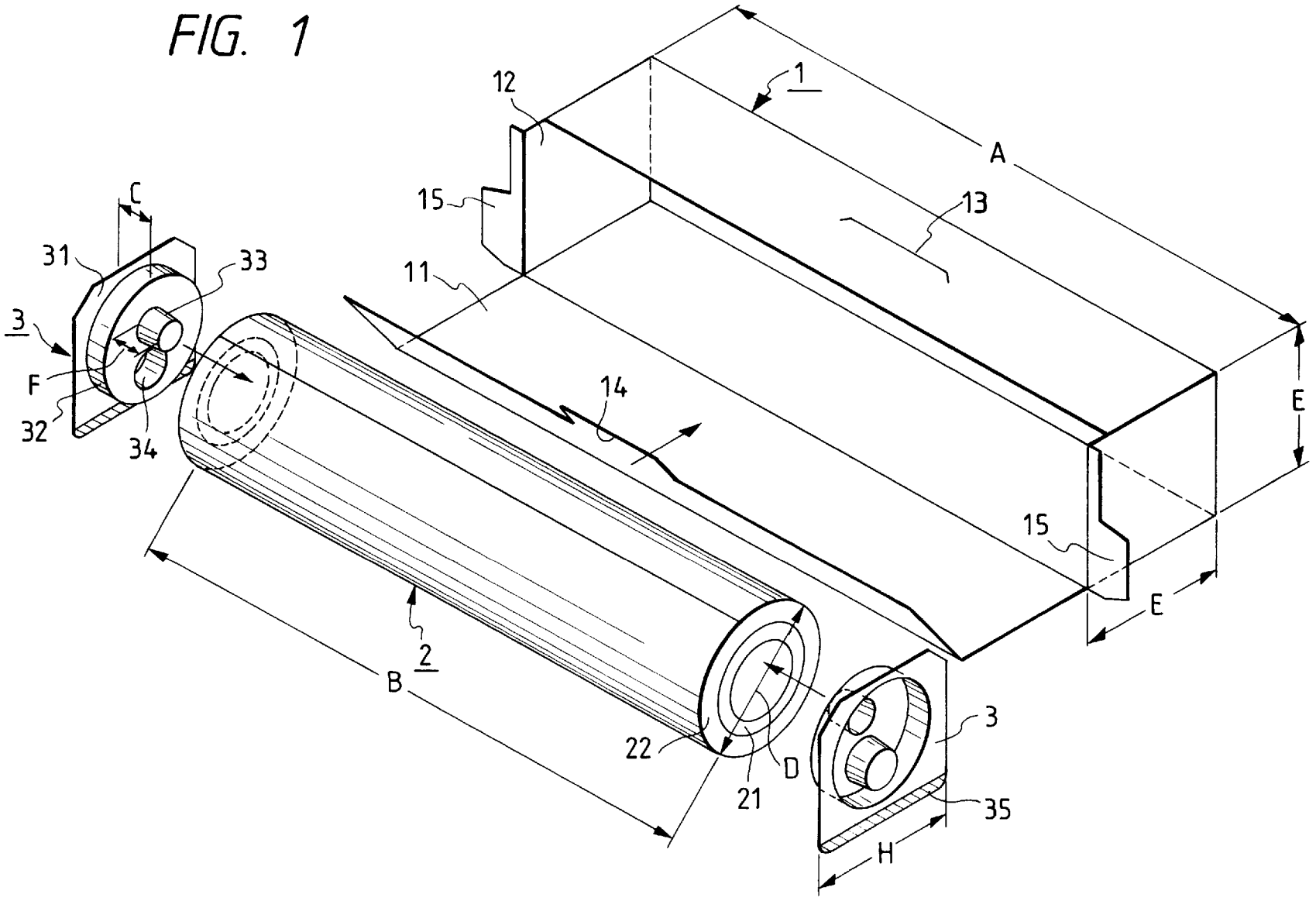
FIG. 1 is a perspective drawing for explaining the overall constitution of the roll sheet supporting member and the box according to the present invention.

Referring to the drawings, embodiments according to the present invention will be described in detail below.

<First Embodiment>

Referring to the drawings, an example of the roll sheet (called "a roll paper" for printing or only "a roll paper") supporting member and the box according to the present invention will be described below.

First, referring to FIG. 1, the overall constitution of the box for holding the roll sheet for printing will be described below.

The box 1 is provided with a bottom face and a side face in the shape of a rectangle of which length of the shorter side is E in inner dimensions and of which length of the longer side is A in inner dimensions, and end faces consisting of a square of which length of one side is E in inner dimensions. The box 1 is provided with an opening 12 along the longer side, a cover 11 for covering the opening 12 so that the cover can be opened or closed freely and a door portion 15 consisting of a piece provided on the end of the end face. Further, a projection 14 is provided at the end in the lateral direction of the above-described cover 11. The opening 12 can be closed by inserting the projection 14 into a slit 13 formed on the box 1. The roll sheet for printing 2 (hereinafter called only "a roll paper") described later and a pair of supporting members 3 can be housed in the box 1 through this opening 12.

The roll sheet 2 consists of the hollow cylindrical core 21 and recording paper 22 wound on the peripheral surface of the core 21. The diameter D of the roll sheet is smaller than the length of one side of the above-described end face, E. When the roll sheet 2 is sold or distributed, it is wrapped in a protective sheet (not shown). The reason is that recording paper is required to be protected from changes of the environment such as temperature and humidity when the roll sheet is sold or distributed.

Figure 2B:
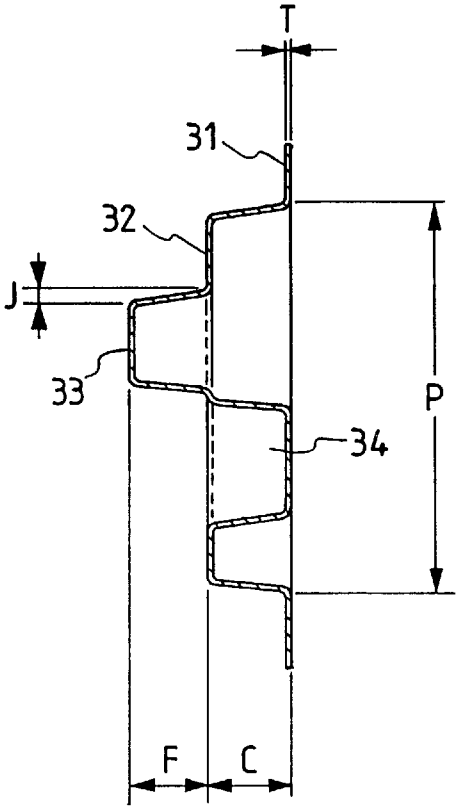
FIGS. 2A and 2B explain the constitution of the roll sheet supporting member according to the present invention.
Figure 2A:
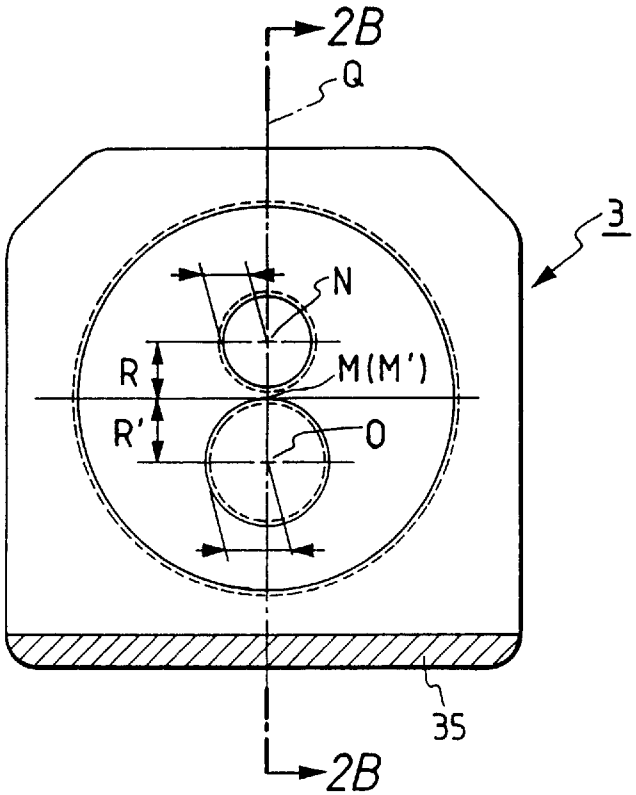

FIG. 2A is a plan view for explaining the constitution of a supporting member 3, FIG. 2B is a cross section viewed along a line 2B—2B in FIG. 2A, and the supporting member 3 is formed by forming a flat portion 31, a base portion 32 formed in a solid rod shape by protruding a part of the flat portion 31, a convex portion (shaft) 33 protruded on the base portion 32 and a concave portion (roll off) 34 formed on the base portion 32 integrally. In this embodiment, the base portion 32, the shaft 33 and the roll off 34 of the supporting member 3 are formed integrally by vacuum forming of sheet material consisting of strong impact-resistant polystyrene (HIPS).

As shown in FIG. 2A, the flat portion 31 has the upper edge provided with two corners cut largely and the lower edge provided with two corners worked in the shape of an arc. A colored mark is put along the edge of the lower end. Therefore, the box direction of the supporting member 3 in the box when it is used can be readily checked by this mark, in this embodiment, the center M of the flat portion 31 and the center M' of the cylindrical base portion 32 are a little off vertically and are formed according to the positional relationship meeting the following relationship:

When a pair of supporting members are combined by rotating them each other by 180 degrees, the dimensions G (See FIG. 3.) between the lower end of one of the supporting members and the lower end of another shall be less than the inner dimensions of the box E. The diameter P of the base portion 32 is larger than the inside diameter of the hollow core 21 of the roll sheet. The center N of the shaft 33 and the center 0 of the concave portion 34 are located on a straight line Q passing through the center M' of the base portion 32 and intersecting the upper end or the lower end perpendicularly. Further, the center N of the shaft 33 is located in the position distant by a distance R from the center of the dimensions G on the upper end side on the straight line Q. In the meantime, the center 0 of the concave portion 34 is located in the position distant by the same distance R' (R'=R) from the center of the dimension G on the lower end side on the straight line Q.

As shown in FIG. 2B, the height F from the base portion 32 to the top of the shaft 33 is formed lower at least by the thickness (=T) of sheet material than the height C from the flat portion 31 to the top of the base portion 32 (that is, $C \geqq T+F$). The concave portion 34 is provided with the inside diameter larger than the outside diameter of the shaft 33 and the depth C larger than the above-described height F. Further, on at least the upper portion of the shaft 33, that is, the portion to support the roll sheet 2, slope J along the direction of the shaft is formed and the shaft 33 is tapered.

Figure 3:
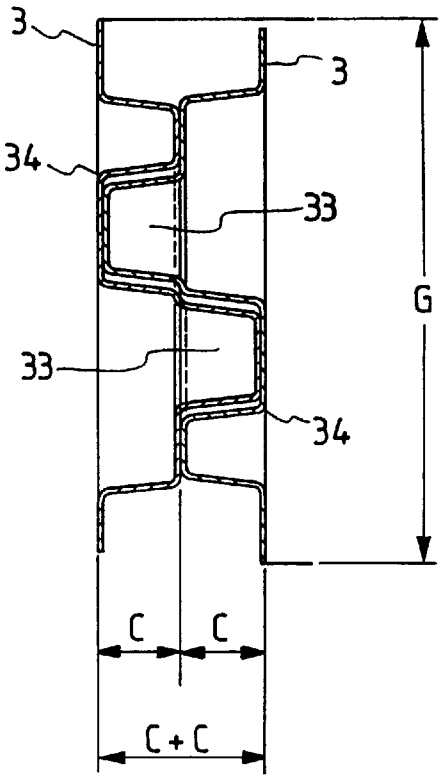
FIG. 3 is a cross section for explaining the constitution in case roll sheet supporting members according to the present invention are combined.

Next, referring to a cross section showing a state in which a pair of supporting members 3 are combined, FIG. 3 and a perspective drawing showing a state in which a pair of supporting members and the roll sheet are housed in the box 1, FIG. 4, the condition of the box for the roll sheet when it is sold or distributed will be described.

The roll sheet 2 and two supporting members are housed in the box 1 when they are sold or distributed. That is, as shown in FIG. 3, two supporting members 3 are combined with one shaft 33 inserted into another roll off 34 in the position on the straight line Q where the supporting members are each other rotated by 180 degrees around the center of the dimensions G so that each base portion 32 is in contact with each other. The supporting members are housed in the box 1 in such a combined state with them gathered together on the side of one end of the box. The roll sheet 2 wrapped in a protective sheet is housed next to them. After box, the projection 14 of the cover 11 which can be opened or closed is inserted into the slit 13 formed on the box 1 to close the opening 12. (See FIG. 4.)

Figure 5:
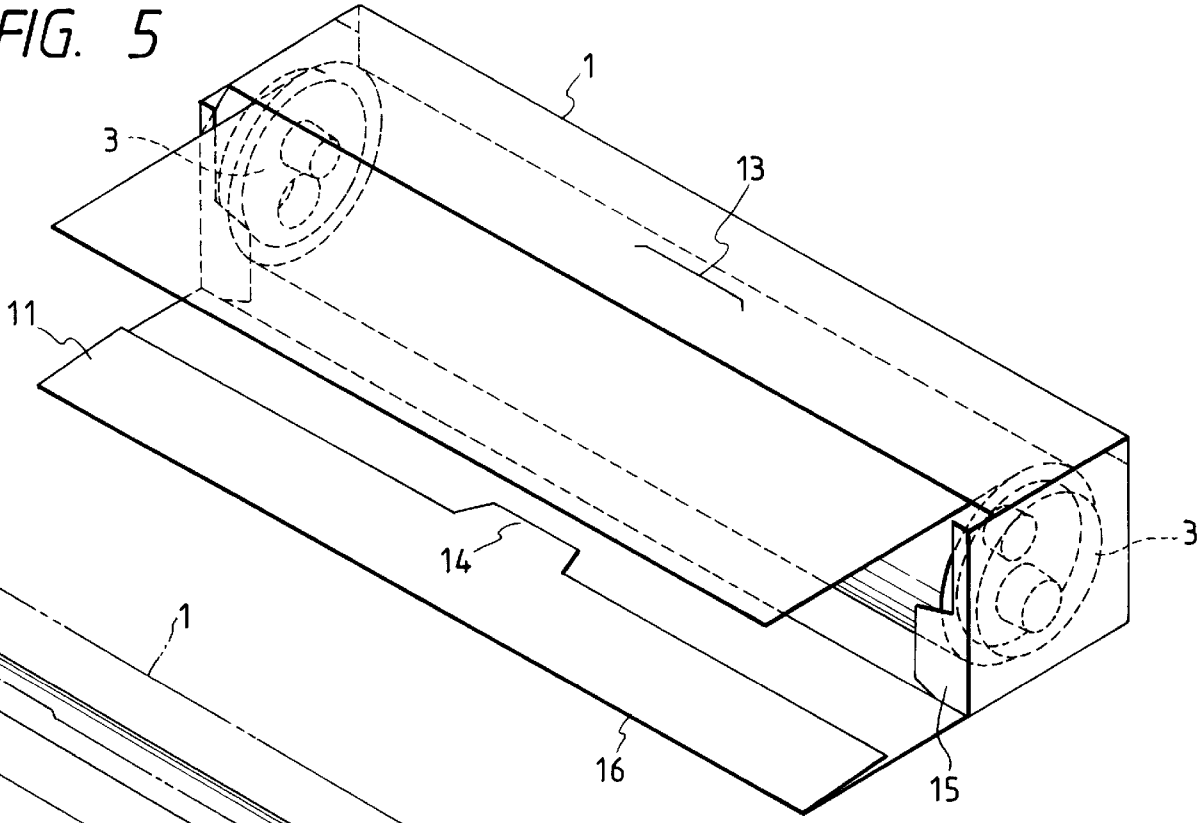
FIG. 5 is a perspective drawing for explaining the constitution of the roll sheet supporting member and the box according to the present invention when printing is performed.
Figure 6:
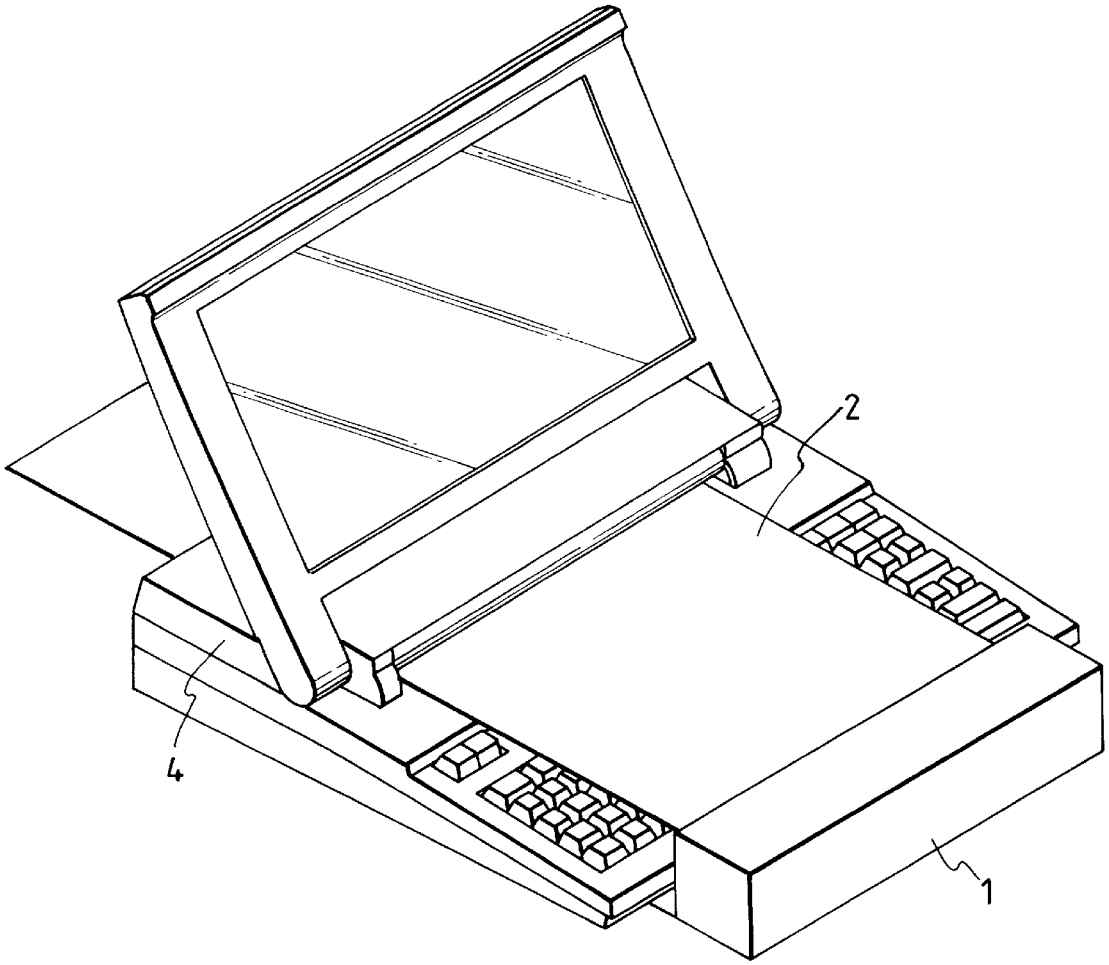
FIG. 6 is a perspective drawing for explaining the constitution of the roll sheet supporting member and the box according to the present invention when the roll sheet is set in a word processor.

Next, referring to a perspective drawing showing a state in which the cover of the box is opened, FIG. 5 and a perspective drawing showing a state in which the roll sheet is set in a word processor, FIG. 6, the state of the box for the roll sheet for printing when it is used for printing will be described.

Figure 4:
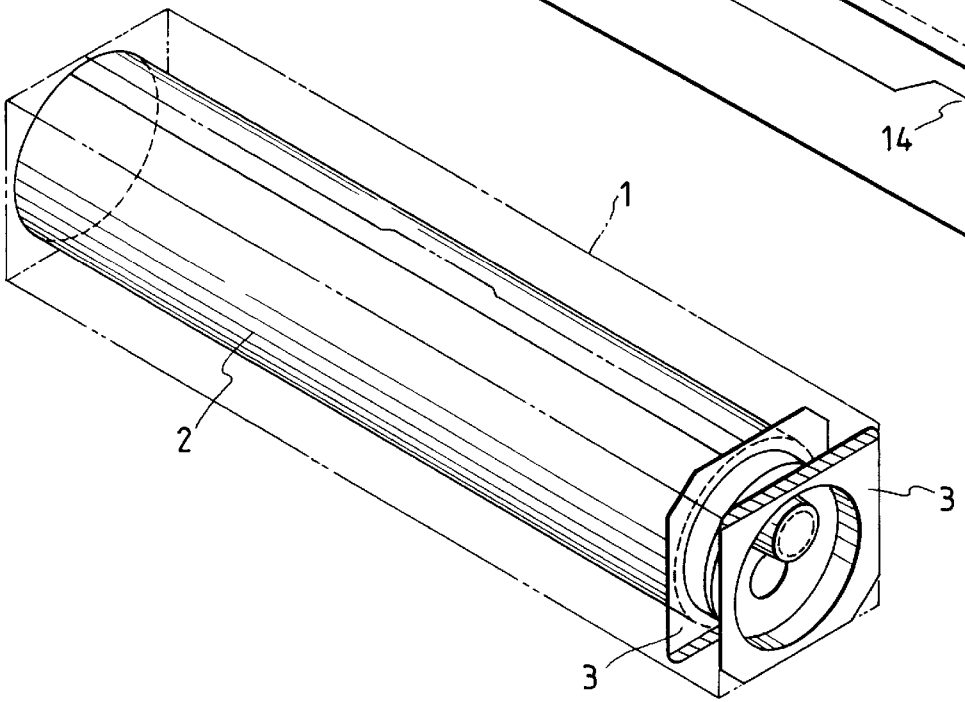
FIG. 4 is a perspective drawing for explaining the constitution of the roll sheet supporting member and the box according to the present invention.

When used for printing, the roll sheet 2 wrapped in a protective sheet and two supporting members 3 are first taken out of the box 1 from the state shown in FIG. 4. Next, after the protective sheet is removed from the roll sheet 2, the supporting members 3 are attached to both ends of the roll sheet 2. That is, first, the shafts 33 are inserted into the hollow core 21 of the roll sheet 2. At this time, the roll sheet 2 is housed in the box 1 in a working state so that the colored portion 35 of the supporting member 3 is located on the lower side of the box. The above-described cover 11 is opened as far as a horizontal position and in the meantime, the door portions 15 on both ends of the opening 12 are closed. In the meantime, the opened cover 11 is folded at the ridgeline 16, a word processor 4 is mounted on it and the box 1 and the word processor 4 are positioned.

Before starting printing, one end of the roll sheet 2 is pulled out of the opening 12 of the box 1 and is set to the printer of the word processor 4. At this time, closing the door portions 15 functions as a stopper to prevent the roll sheet 2 and the supporting members 3 together from being pulled out of the box 1 when the roll sheet 2 is pulled by the printer of the word processor 4. In this embodiment, the roll sheet 2 is pulled out in the horizontal direction approximately in parallel to the cover 11 and is set in the printer of the word processor 4.

Next, when the dimensions of the box 1, the roll sheet 2 and the supporting member 3 are described, the inner dimensions of the box 1, the dimensions of the roll sheet 2 and those of the supporting member 3 are related as follows: [Number 1]

$$B+2\times C \leqq A < B+2\times C+F \quad (1)$$

$$D<E \quad (2)$$

$$G \leqq E \quad (3)$$

$$H \leqq E \quad (4)$$

A, E: Inner dimensions of box 1

B, D: Outside dimensions of roll sheet 2

C, F, H: Outside dimensions of supporting member 3

G: Outside dimensions of supporting members 3 when combined

In this embodiment, respective dimensions are set so that A=280 mm, B=257 mm, C=10 mm, ϕD=ϕ58 mm, E=62 mm, F=9.3 mm, G=60 mm, H=60 mm, J=1 mm (=slope of the shaft 33) and M=0.7 mm (=the thickness of sheet material).

When the roll sheet is used, a gap in the direction of the width between the roll sheet 2 and the base portion 32 of the pair of supporting members 3 is 3 mm (=280−257−10−10). The roll sheet 2 is positioned in the box 1 with misregistration precision of 3 mm (max.). Further, as described above, as the box 1 is positioned by a word processor 4, the roll sheet 2 is also positioned by the word processor 4. As the height F of the shaft 33 is 9.3 mm, the roll sheet 2 is not dropped from the shaft 33 of the supporting member 3 when it is used even if the roll sheet 2 is off within the above-described precision 3 mm in the direction of the width in the box 1.

Figure 7:
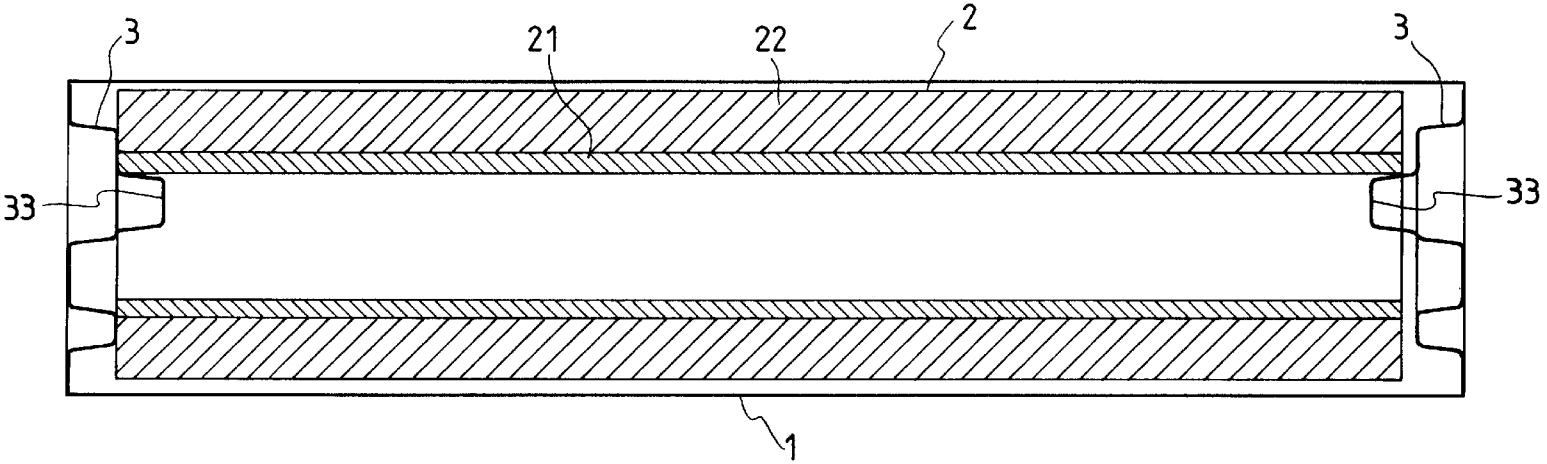
FIG. 7 is a cross section for explaining the constitution of the roll sheet supporting member and the box according to the present invention.
Figure 8:
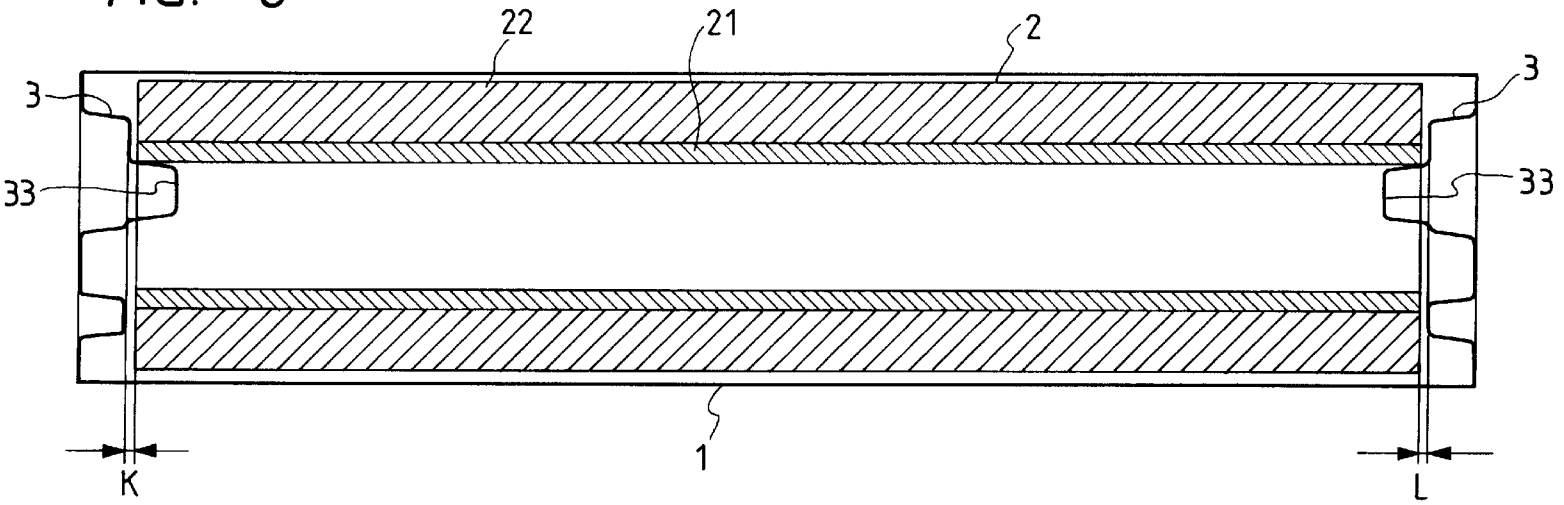
FIG. 8 is a cross section for explaining the constitution of the roll sheet supporting member and the box according to the present invention.

Immediately after the roll sheet 2 is housed in the box 1 together with a pair of supporting members 3 to use the roll sheet, the roll sheet 2 may be one-sided and supported between the supporting members 3 as shown in FIG. 7. However, as a taper (slope J) is formed on the upper portion of the shaft 33 of the supporting member 3, the roll sheet 2 is stabilized approximately in the center of a pair of supporting members 3 every time the roll sheet is used and rotated (That is, the roll sheet is stabilized as a gap on the left side, K is equal to a gap on the right side, L. See FIG. 8.). As described above, the roll sheet 2 can be supported stably approximately in the center of the supporting members 3 when the roll sheet is used because the tapered shaft 33 is formed and an inclination of the roll sheet 2 caused due to the difference of posture can be prevented.

When the roll sheet 2 is used, the peripheral surface of the shaft 33 is in contact with the inner wall of the hollow core of the roll sheet 2 with the center M of the supporting member intersected with an extended line of the rotation axis of the roll sheet for printing. By this, the roll sheet for printing is hung by the shafts and is in a state as if the roll sheet were supported approximately in the center of the box 1 (See FIG. 8.) Therefore, when one end of the roll sheet 2 is pulled into the set word processor 4, the precision of the printing position can be kept satisfactory because the roll sheet 2 can be rotated without undergoing an excessive load in the box 1.

In the meantime, the box is constituted so that when sold and distributed, the roll sheet 2 wrapped in a protective sheet is housed with it brought on the one side in the box 1 and so that the pair of supporting members 3 are housed in the residual space with the shaft 33 of one supporting member 3 combined with the concave portion 34 of another supporting member 3 and with each base portion 32 in contact with each other. A gap between the roll sheet 2 and the box 1 at this time and between the roll sheet 2 and the supporting member 3 at this time is also 3 mm as when it is used (=280−257−10−10). As described above, as when sold and distributed, the roll sheet 2 is not supported by the supporting members 3 in the box 1, the supporting member 3 suffers no serious impact when distributed, low-priced material and structure with strength in a low grade can be used because the strength of the supporting member 3 and the box 1 can be minimized to the extent required when the roll sheet is used, and low costs can be implemented.

In this embodiment, the concave portion 34 is formed on the base portion 32 as the roll off of the shaft 33 of another supporting member 3 when the supporting members are combined when the roll sheet is not used, however, the roll off may be also only a hole. Sheet material consisting of strong impact-resistant polystyrene (HIPS) is used for material of the supporting member 3, however, thermoplastic resin such as vinyl chloride or other material, further the other forming method can be also used.

<Second Embodiment>

Figure 9A:
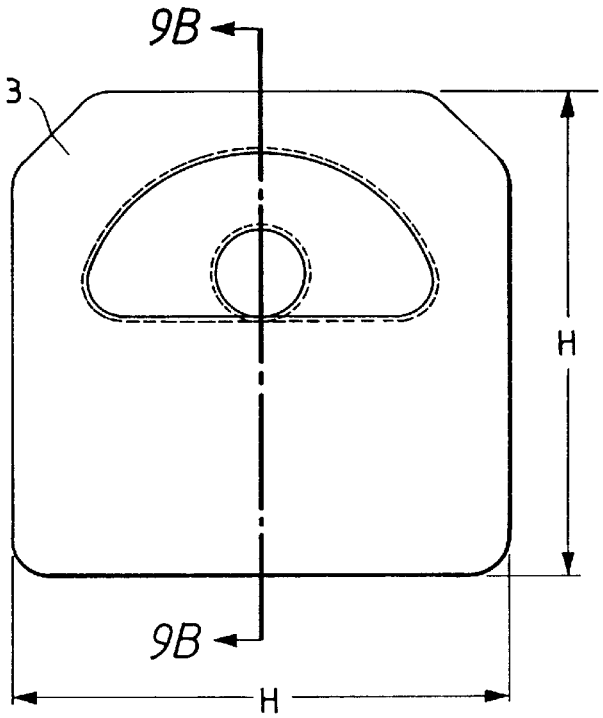
FIGS. 9A and 9B explain the constitution of the roll sheet supporting member according to the present invention, FIG.
Figure 9B:
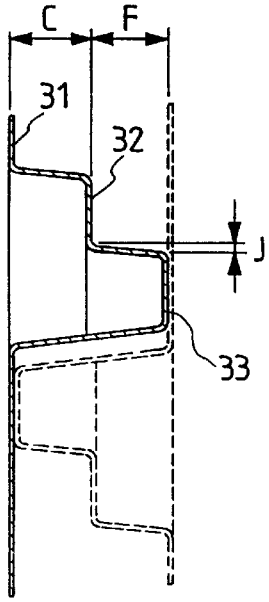

FIGS. 9A and 9B show a second embodiment of a supporting member to which the present invention is applied, FIG. 9A is a plan view and FIG. 9B is a cross sectional view along a line 9B–9B in FIG. 9A.

The base portion 32 and the shaft 33 of this supporting member are formed integrally by vacuum forming of sheet material consisting of strong impact-resistant polystyrene (HIPS) as in the first embodiment.

The points different from the first embodiment are that the section of the base portion 32 is formed in the shape of an arc and that a concave portion 34 is not formed. Therefore, when a pair of supporting members are combined because the base portion 32 is formed in the shape of an arc, each base portion 32 is combined so that it does not hit another shaft 33 as shown in FIG. 9B.

The relationship in dimension between the box 1 using the supporting members according to this embodiment and the roll sheet 2 meets the relational expression (1) to (4) in the first embodiment.

<Third Embodiment>

Figure 10A:
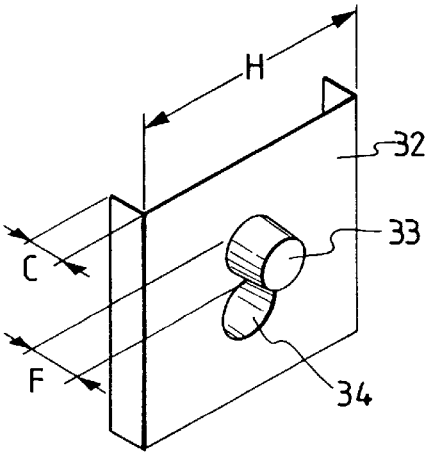
FIGS. 10A and 10B are perspective drawings for explaining the constitution of the roll sheet supporting member according to the present invention.
Figure 10B:
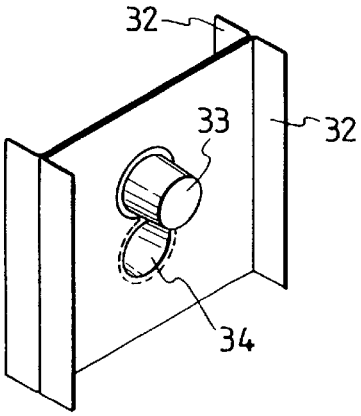

FIGS. 10A and 10B show a third embodiment of a supporting member to which the present invention is applied, FIG. 10A is a perspective drawing showing the supporting member and FIG. 10B is a perspective drawing showing the case that a pair of supporting members are combined.

The supporting member is provided with a base portion 32 the shape of which section is approximately in the shape of U, a tapered shaft mounted on the surface of the base portion 32 and a hole formed on the surface of the base portion 32 into which the shaft of another supporting member is inserted.

The relationship in dimensions between the box 1 using the supporting members according to the present invention and the roll sheet 2 meets the relational expression (1) to (4) in the first embodiment.

<Fourth Embodiment>

Figure 11:
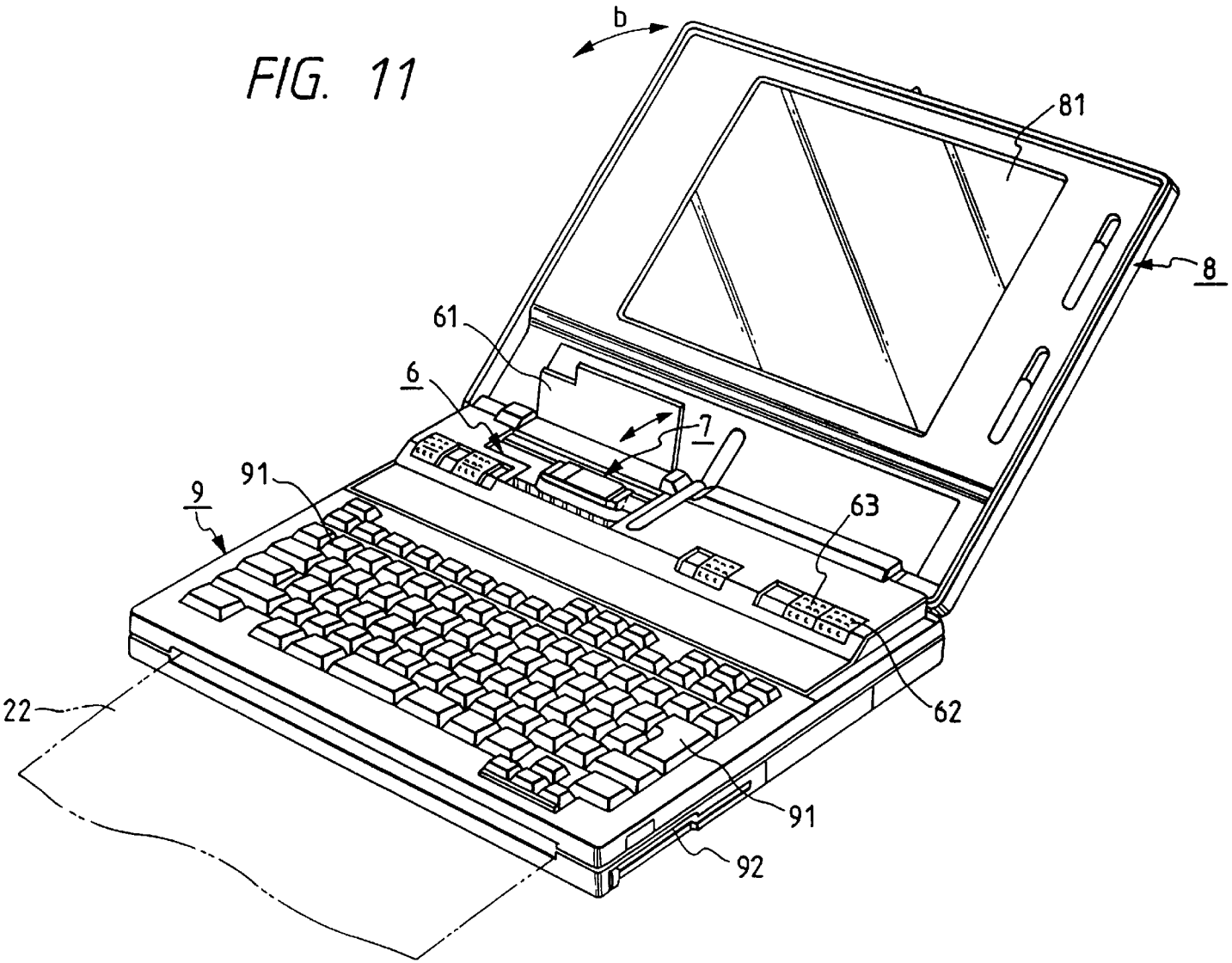
FIG. 11 is a perspective drawing for explaining the constitution of a personal computer to which the roll sheet supporting member and the box according to the present invention are applicable.
Figure 12:
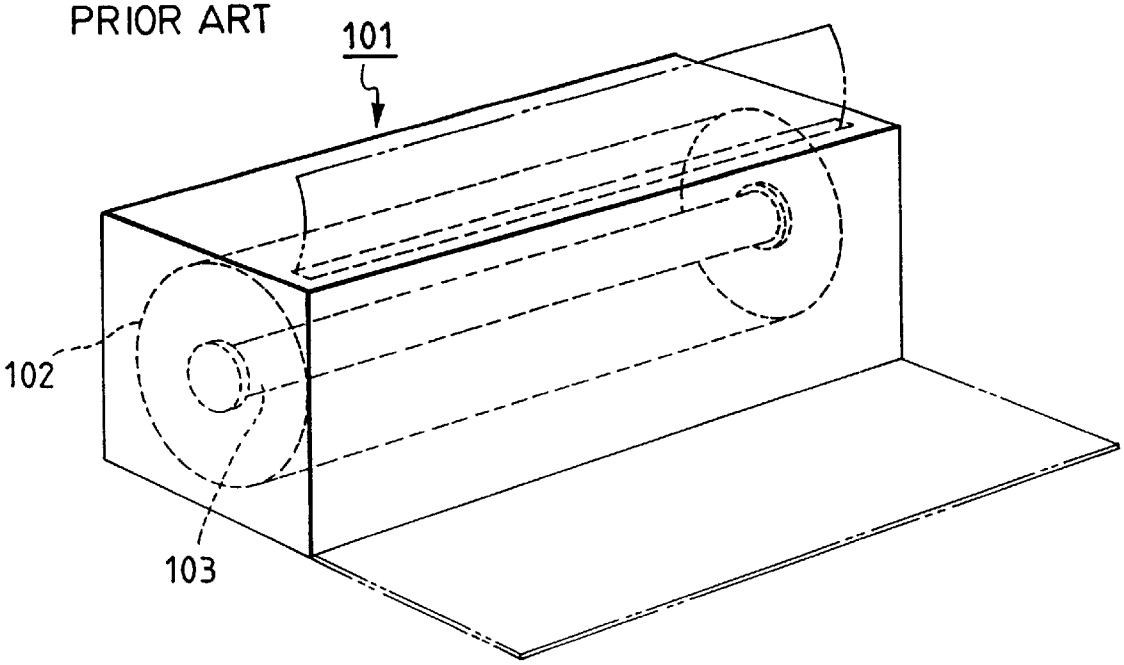
FIG. 12 PRIOR ART
FIG. 12 is a perspective drawing for explaining the constitution of the conventional roll sheet supporting member and the box.
Figure 13:
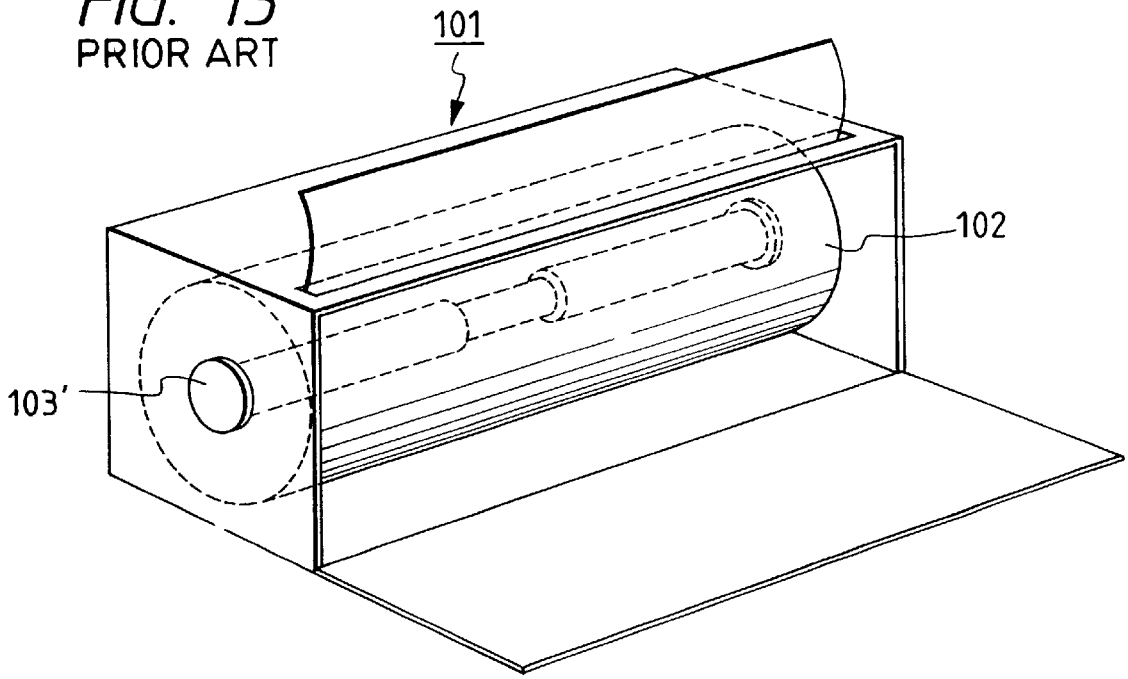
FIG. 13 PRIOR ART
FIG. 13 is a perspective drawing for explaining the constitution of the conventional roll sheet supporting member and the box.
Figure 14:
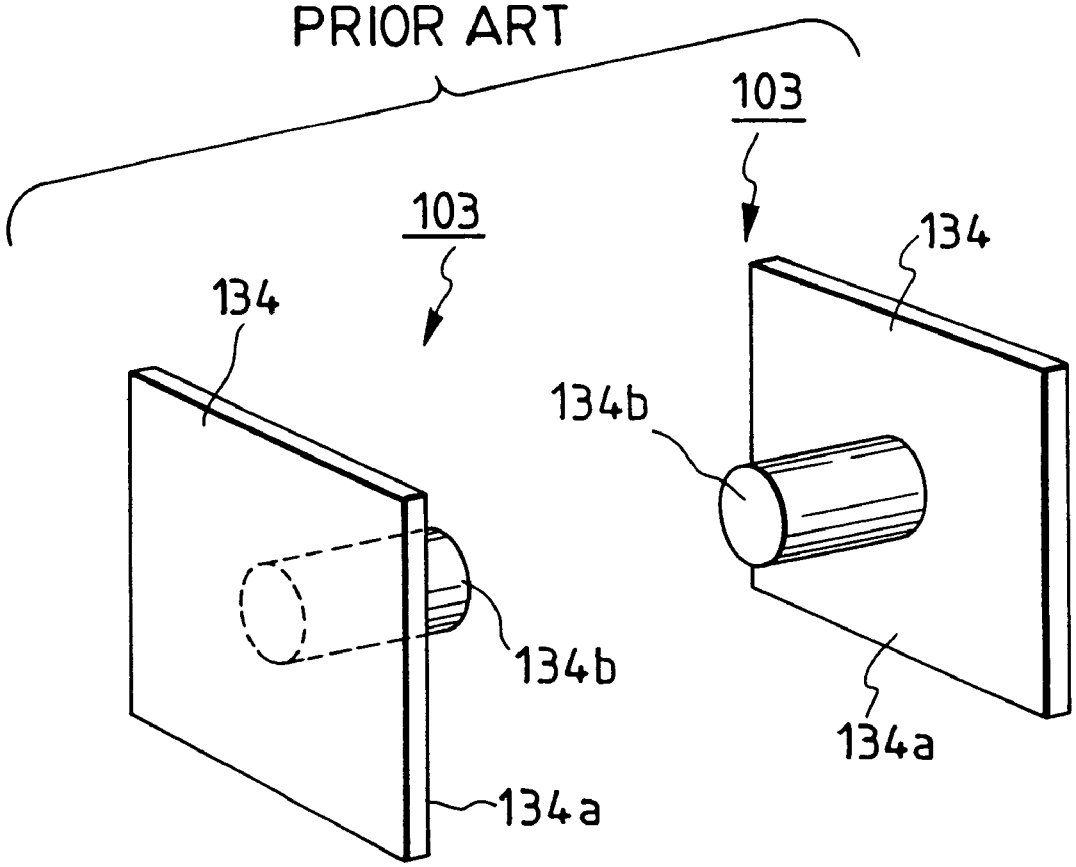
FIG. 14 PRIOR ART
FIG. 14 is a perspective drawing for explaining the constitution of the conventional roll sheet supporting member.

FIG. 11 is a perspective drawing showing a personal computer as an example of an information processing system to which recording paper is supplied by the box for the roll sheet for printing according to the present invention. This personal computer is provided with an ink jet recording apparatus on which an ink jet recording head and an ink reservoir for supplying ink to the recording head are mounted so that they can be attached or detached.

A reference number 6 designates a printer consisting of the ink jet recording apparatus, a reference number 9 designates a keyboard provided with a key 91 for inputting a character, a number and the other characters and a key for issuing a variety of instructions, and a reference number 8 designates a display for displaying processing information provided with a display screen 81.

In the printer 6, a window 61 is formed by transparent plastic and via the window 61, the movement of a head cartridge 7 can be checked. The window 61 is constituted so that it can be opened or closed when ink reservoirs are replaced. Keys 62 and 63 instruct operation in the printer such as recovery processing and recording paper feed in the printer. A floppy disk drive 92 is provided under the key board 9.

The display 87 is constituted so that it can be turned in the direction shown by an arrow b in FIG. 11 to fold the display with it integrated with the key board 9 when the personal computer is carried. The key board 9 is constituted so that it can be turned in the direction of an arrow a in FIG. 11 when recording paper 22 is set in the printer 6.

The box for the roll sheet for printing used for a personal computer constituted as described above is constituted as either of the first or third embodiment, however, the box is different from the first and third embodiments in the following: That is, in examples shown in FIGS. 5 and 6, the roll sheet 2 is output from the upper side of the box, however, in this embodiment, it is output from the lower side of the box 1.

The ink jet recording apparatus provided to the personal computer according to the present invention uses an electrothermal conversion element for generating film boiling in ink as an energy generation element of the recording head.

As the recording head using such an electrothermal conversion element as an energy generation means can generate bubbles in ink in a passage according to the correspondence of one for one by a drive pulse signal and can grow or shrink bubbles immediately and appropriately, emitting ink droplets particularly according to excellent responsibility can be achieved. As the recording head can be also compacted readily, the merits of IC techniques and microcomputer processing techniques of which progress of technology and enhancement of reliability are remarkable in recent semiconductor field can be applied more than enough, high density packaging is facilitated and the manufacturing cost is low-priced, the recording head is profitable.

In the above-described embodiments 1 to 4, an example applied to an information processing system such as a word processor was described, however, it will be of course readily understandable that the shape and the constitution of the roll sheet supporting member and the box shown in the above-described embodiments can be applied to roll paper such as cooking paper and a paper towel used for home use or for business use. Further, it is of course that a variety of variations may exist within the range of the present invention without being limited to the above-described embodiments. Furthermore, in the present invention, a term, "sheet" or "paper" is used, however, of course, sheet material consisting of aluminum or plastic or material which can be rolled such as cloth can be applied without being limited to paper itself.

As described above, by constituting a supporting member for roll paper for home use or for business use such as the roll sheet for printing, cooking paper and a paper towel according to the present invention, the rotation of roll paper is always smoothed, and positioning of roll paper and positioning between the paper and an object to which the paper is supplied are facilitated. In concrete, according to the present invention, a supporting member for roll paper, the holding box for roll paper having the supporting members, a recorder having the box as a recording medium supply means, and an information processing system having the recorder as an output means can be provided. Here, the supporting member can perform the positioning between the information processing system such as a word processor and a facsimile and a roll paper, and the rotation of roll paper in printing can be always performed smooth by.

What is claimed is:

1. A pair of supporting members removably attached to a containing box containing a roll sheet consisting of a cylindrical core and a recording sheet wound on the core for rotatably supporting said roll sheet, each of said supporting members comprising:

a flat portion having an upper edge, a lower edge and a center point; and a shaft portion mounted on said flat portion at a position offset toward the upper edge from the center point of said flat portion, wherein a tapered portion contacting with an inner peripheral surface of the cylindrical core is formed on an outer peripheral surface of said shaft portion for supporting the roll sheet, the tapered portion contacting at an upper area thereof with an opposed area of the inner peripheral surface of the cylindrical core thereby leaving a gap between a lower area of the tapered portion and an opposed area of the inner peripheral surface of the cylindrical core.

2. The pair of supporting members according to claim 1, wherein the center of each of said supporting members is located approximately on an extended line of a rotation axis of said roll sheet when mounted.

3. The pair of supporting members according to claim 1, wherein in each supporting member a shaft escape portion through which said shaft portion can be passed in dimensions is formed on said flat portion.

4. The pair of supporting members according to claim 3, wherein said pair of supporting members are adapted to be positioned opposite each other to be overlapped by rotating one of them by approximately 180 degrees around the center.

5. The pair of supporting members according to claim 1, wherein a base portion of each supporting member is joined by protruding at least a part of said flat portion, and at least said shaft portion is located on said base portion.

6. The pair of supporting members according to claim 5, wherein the center of each supporting member is located on said base portion.

7. The pair of supporting members according to claim 5 or 6, wherein each of said base portions is formed in a solid rod shape or an arch shape in cross section, the minimum diameter of the base portion is larger than an inner diameter of a core of the hollow cylinder.

8. The pair of supporting member according to one of claims 5 and 6, wherein a height of each of the base portions is equal to or larger than a length of said shaft portion.

9. The pair of supporting members according to one of claims 1 to 6, wherein a mark is put on the lower edge of said flat portions.

10. The pair of supporting members according to one of claims 1 to 6, wherein each of said supporting members is made of a molding obtained by vacuum forming of a sheet material of predetermined material.

11. The pair of supporting members according to claim 10, wherein the predetermined material is impact-resistant polystyrene.

12. A method for manufacturing a roll paper according to claim 1, comprising:

a step for forming the supporting member by a vacuum forming of sheet material of predetermined material.

13. A manufacturing method according to claim 12, wherein the predetermined material is thermoplastic resion, and preferably strong impact-resistant polystyrene.

14. A roller sheet containing box comprising a roll sheet consisting of a hollow cylindrical core and a recording sheet wound thereon, a pair of supporting members for rotatably supporting the roll sheet, a box for containing the roll sheet and the pair of supporting members therein and a cover for covering an opening of the box openably/closeably, each of, said supporting members comprising a flat portion having an upper edge, a lower edge and a center point, a shaft portion mounted on said flat portion at a position offset toward the upper edge from the center point of said flat portion, a shaft escape portion formed on said flat portion for permitting passage of said shaft portion dimensionally, wherein a tapered portion contacting with an inner peripheral surface of the cylindrical core is formed on an outer peripheral surface of said shaft portion for supporting the roil sheet, the tapered portion contacting at an upper area thereof with an opposed area of the inner peripheral surface of the cylindrical core with leaving a gap between a lower area of the tapered portion and an opposed area of the inner peripheral surface of the cylindrical core, and wherein when paired supporting members are adapted to be overlapped in a state where the shaft portion mounted on said flat portion is contained in the shaft escape portion so that paired supporting members are contained in a space formed between a side edge of the roll sheet and a side wall of the box to regulate an axial movement of the roll sheet.

15. The roller sheet containing box according to claim 14, wherein the center of each of said supporting members is located on an extended line of a rotation axis of said roll sheet when mounted.

16. The roller sheet containing box according to claim 15, wherein said pair of supporting members are opposite each other, and are overlapped by rotating one of them by approximately 180 degrees around the center.

17. The roller sheet containing box according to claim 16, wherein said pair of supporting members are housed in said box with overlapped condition when they are not used.

18. The roller sheet containing box according to claim 14, wherein a base portion is provided by protruding at least a part of said flat portion, and at least said shaft portion is located on said base portion.

19. The roller sheet containing box according to claim 18, wherein the center is located on said base portion.

20. The roller sheet containing box according to claim 18 or 19, wherein said base portion is formed approximately in the shape of a solid rod or an arch in cross section, the minimum diameter of the base portion is larger than an inner diameter of a core of said hollow cylinder.

21. The roller sheet containing box according to one of claim 18 to 19, wherein a height of said base portion is equal to or larger than a length of said shaft portion.

22. The roller sheet containing box according to one of claim 14 to 19, wherein a mark is put on the lower edge of said flat portion.

23. The roller sheet containing box according to one of claim 14 to 19, further comprising fixing means for fixing and supporting said supporting member on an inner end face of said box to be detached or attached from freely.

24. The roller sheet containing box according to one of claim 14 to 19, wherein said supporting member is formed by a molding obtained by vacuum forming of sheet material of predetermined material.

25. The roller sheet containing box according to claim 24, wherein said predetermined material is thermoplastic resin.

26. A process for manufacturing a roller sheet containing box comprising the step of housing a pair of supporting members for rotatably supporting a roll sheet in a box, the supporting members comprising a flat portion having an upper edge, a lower edge and a center point, a shaft portion mounted on said flat portion at a position offset toward the upper edge from the center point of said flat portion, and a shaft escape portion formed on said flat portion for permitting passage of said shaft portion dimensionally, wherein a tapered portion contacting with an inner peripheral surface of the cylindrical core is formed on an outer peripheral surface of said shaft portion for supporting the roll sheet, the tapered portion contacting at an upper area thereof with an opposed area of the inner peripheral surface of the cylindrical core with leaving a gap between a lower area of the tapered portion and an opposed area of the inner peripheral surface of the cylindrical core, wherein when paired supporting members are adapted to be overlapped in a state where the shaft portion mounted on said flat portion is contained in the shaft escape portion so that paired supporting members are contained in a space formed between a side edge of the roll sheet and a side wall of the box to regulate an axial movement of the roll sheet, and wherein said roll paper and said pair of supporting members are housed in said box independent of each other.

27. The manufacturing process according to claim 26, wherein said roll paper is wrapped separately from said pair of supporting members.

28. The manufacturing process according to claim 26, further comprising:

a step for overlapping said pair of supporting members by opposing each other and rotating one member by 180 degrees around the center;

a step for abutting one surface of said overlapped pair of supporting members with one end of said box; and a step for setting one end face of said roll paper and said supporting members oppositely in a space adjacent to said pair of supporting members abutted to the one end.

29. The manufacturing process according to claim 26, wherein said roll sheet is positioned in said box in a widthwise direction thereof by passing a shaft of said supporting member through a core of said roll paper, and regulating the said roll sheet in a widthwise direction by moving a base portion of said supporting member.

30. A recording apparatus, comprising:

a roller sheet containing box according to claim 14 as recording paper supply means; and a recording means for performing a recording of input image information by emitting ink droplets on the recording paper.

31. A holding unit holding a roll sheet consisting of a cylindrical core and a recording paper wound on the core, said holding unit comprising:

a pair of supporting members, each supporting member comprising a base portion and a shaft portion, each of said shaft portions contact an inner peripheral surface of said cylindrical core at opposite ends of said cylindrical core thereby supporting the roll sheet, said shaft portions each provided with a tapered portion converging toward a central portion of the cylindrical core, said tapered portions contacting with said inner peripheral surface of said cylindrical core thereby supporting the roll sheet, said inner peripheral surface of said cylindrical core and an outer peripheral surface of said shaft portion are spaced apart such that said cylindrical core is hung from said shaft portions, and gaps being provided between said opposite ends of said cylindrical core and corresponding ones of said base portions so that said cylindrical core is capable of moving longitudinally with respect to said supporting members, wherein a conveyance of said recording paper causes a rotation of said cylindrical core relative to said supporting members, and said tapered portions assist in adjusting a position of said cylindrical core to maintain said cylindrical core in position with respect to said supporting members during said rotation.

32. A first supporting member and a second supporting member removably attached to a container box having a containing portion with opposing side ends, said container box containing a roll sheet consisting of a cylindrical core and a recording sheet wound on the core thereby rotatably supporting said roll sheet, wherein:

each of said supporting members comprises a shaft portion contacting with an inner peripheral surface of said cylindrical core thereby supporting the roll sheet, and a base portion holding the shaft portion at a predetermined height in the containing box when the supporting members are disposed at corresponding ones of said side ends of said containing portion, said base portion having a first side with an abutment face and a shaft escape portion, and said shaft portion extends from said first side of said base portion, wherein the supporting members may be stored together on one side of said container portion in a storage position with said abutment face of said first support member in abutting contact with the abutment face of said second support member and said shaft portion of said first supporting member received in said shaft escape portion of said second supporting member and said shaft portion of said second supporting member received in said shaft escape portion of said first supporting member.

* * * * *

UNITED STATES PATENT AND TRADEMARK OFFICE

CERTIFICATE OF CORRECTION

PATENT NO. : 5,904,329

DATED : May 18, 1999

INVENTOR(S) : YUJI KANOME, ET AL.

It is certified that error appears in the above-identified patent and that said Letters Patent is hereby corrected as shown below:

COLUMN 2,
Line 54, "problem" should read --problem occurs--; and
Line 56, "printing occurs." should read --printing.--.
COLUMN 5,
Line 2, "independent" should read --independently--.
COLUMN 13,
Line 50, "roil" should read --roll--.
COLUMN 14,
Line 27, "from" should be deleted.

UNITED STATES PATENT AND TRADEMARK OFFICE

CERTIFICATE OF CORRECTION

PATENT NO. : 5,904,329

DATED : May 18, 1999

INVENTOR(S) : YUJI KANOME, ET AL.

It is certified that error appears in the above-identified patent and that said Letters Patent is hereby corrected as shown below:

COLUMN 5,
Line 54, "not" should read -not only-.

COLUMN 6,
Line 1, "off" should be deleted;
Line 6, "box" should read -boxing-;
Line 28, "excellent particularly in responsibility" should read -accurately-; and
Line 35, "profittable." should read -profitable.-.

COLUMN 8,
Line 22, "0" should read -O-;
Line 28, "0" should read -O-;
Line 53, "each" should read -with respect to each-; and
Line 58, "box," should read -boxing,-.

COLUMN 9,
Line 46, "øD = ø58 mm," should read -D = 58 mm,-.

UNITED STATES PATENT AND TRADEMARK OFFICE

CERTIFICATE OF CORRECTION

PATENT NO. : 5,904,329

DATED : May 18, 1999

INVENTOR(S) : YUJI KANOME, ET AL.

It is certified that error appears in the above-identified patent and that said Letters Patent is hereby corrected as shown below:

COLUMN 11,
Line 42, "87" should read -81-.

COLUMN 12,
Line 34, "smooth by." should read -smoothly.-.

Signed and Sealed this

Twenty-ninth Day of February, 2000

*Attest:*

Q. TODD DICKINSON

*Attesting Officer*

*Commissioner of Patents and Trademarks*